US007922541B2

(12) United States Patent
Maenhout et al.

(10) Patent No.: US 7,922,541 B2
(45) Date of Patent: Apr. 12, 2011

(54) CABLE CONNECTOR

(75) Inventors: Koenraad Maenhout, Kortrijk (BE); Domien Crevits, Lichtervelde (BE)

(73) Assignee: Barco NV (BE)

( * ) Notice: Subject to any disclaimer, the term of this patent is extended or adjusted under 35 U.S.C. 154(b) by 0 days.

(21) Appl. No.: 12/253,748

(22) Filed: Oct. 17, 2008

(65) Prior Publication Data

US 2010/0099303 A1 Apr. 22, 2010

(51) Int. Cl.
*H01R 13/40* (2006.01)

(52) U.S. Cl. ..... 439/625

(58) Field of Classification Search ..... 439/625, 439/40–404, 417, 492

See application file for complete search history.

(56) References Cited

U.S. PATENT DOCUMENTS

| | | | | |
|---|---|---|---|---|
| 1,825,208 | A | 9/1931 | Rumble | |
| 5,338,220 | A * | 8/1994 | Soes et al. | 439/403 |
| 6,039,596 | A | 3/2000 | Whiteman, Jr. et al. | |
| 7,160,140 | B1 | 1/2007 | Mrakovich et al. | |
| 7,416,445 | B1 * | 8/2008 | Brown | 439/596 |
| 7,530,827 | B2 * | 5/2009 | Caveney et al. | 439/211 |
| 7,604,498 | B2 * | 10/2009 | Mahajan | 439/410 |
| 7,731,521 | B2 * | 6/2010 | Corradi et al. | 439/417 |
| 2007/0087619 | A1 | 4/2007 | Nall et al. | |
| 2007/0170338 | A1 | 7/2007 | Ueda et al. | |

FOREIGN PATENT DOCUMENTS

| | | |
|---|---|---|
| EP | 1524726 | 4/2005 |
| WO | WO 00/19565 | 4/2000 |
| WO | WO 2006/085097 | 8/2006 |
| WO | WO 2007/022739 | 3/2007 |
| WO | WO 2007/023261 | 3/2007 |
| WO | WO 2007/028399 | 3/2007 |

OTHER PUBLICATIONS

Invitation to Pay Additional Fees and, Where Applicable, Protest Fee dated Mar. 31, 2010 for related PCT Application No. PCT/IB2009/007148.

International Search Report and Written Opinion of the International Searching Authority dated Jun. 15, 2010 for related PCT Application No. PCT/IB/2009/007148.

* cited by examiner

*Primary Examiner* — Jean F Duverne

(74) *Attorney, Agent, or Firm* — Ryan A. Schneider, Esq.; Troutman Sanders LLP

(57) ABSTRACT

The disclosure herein describes embodiments of a cable connector that can be easily attached at a variety of points along the length of a cable as desired by a user for a particular application. The cable connector can easily be secured to the cable by snapping or otherwise securing the base and cover of the connector around the cable. The cable connector can include a device interface for coupling an electronic device to the cable connector. The cable connector can supply a power and control signal to the coupled device via terminals adapted to pierce the insulation on the cable and contact the conductors inside. The terminals of the cable connector can sever at least one of the conductors of the cable, disrupting the flow of current through the conductor. The device interface can bridge the severed ends of the conductor to enable unabated current flow when a device is not coupled thereto or redirect the current through an electronic device coupled to the interface. The cable connector enables easily connecting an electronic device in series between the severed ends of a conductor and providing current flow between the ends when the device is disconnect.

30 Claims, 11 Drawing Sheets

CABLE CONNECTOR

BACKGROUND

In various applications, such as video display applications, a multitude of individual electronic devices functioning in unison or separately are employed. For example, an array of small display devices may be used to form a larger image. These electronic devices require a power source and often a control signal. A cable connector with a device interface can couple such electronic devices to a cable carrying a power supply and a control signal for the device. Such cable assemblies are often prefabricated with a plurality of cable connectors attached to the cable at fixed intervals.

In particular applications, the desired distance between electronic devices often varies from the fixed distance between the cable connectors. To achieve the desired distance and placement of the devices, the excess cable between adjacent connectors must be bundled and secured. The excess bundle of cable, however, interferes with the smooth application of the cable and devices. The excess cable bundle may be difficult to hide and increase installation time of the electronic devices.

A cable connector with a device interface capable of attaching at a point desired by a user along the length of a cable would reduce or possibly eliminate the need to bundle excess cable when employing electronic devices spaced apart at varying distances.

SUMMARY

Embodiments described herein are directed to a cable connector that can be easily attached at a variety of points along the length of a cable, as desired by a user for a particular application. The cable connector can be easily secured to the cable by snapping or otherwise securing the base and cover of the connector around the cable. The cable connector can include a device interface for coupling an electronic device to the cable connector. The cable connector can supply a power and control signal to the coupled device via terminals adapted to pierce the insulation on the cable and contact the conductors inside. The terminals of the cable connector can sever at least one of the conductors of the cable, disrupting the flow of current through the conductor. The device interface can bridge the severed ends of the conductor to enable current flow when a device is not coupled thereto or redirect the current through an electronic device coupled to the interface. The cable connector enables easily connecting an electronic device in series between the severed ends of a conductor and providing current flow between the ends when the device is disconnected.

In accordance with an exemplary embodiment, a cable connector can comprise: a base; a cover, the cover connecting to the base, the base and cover when connected defining a conduit receiving a cable, the cable having a first conductor and insulation; a first insulation displacement terminal disposed on the base; a second insulation displacement terminal disposed on the base; and a first isolation terminal disposed on the base between the first insulation displacement terminal and second insulation displacement terminal.

In accordance with another exemplary embodiment, a device interface of a cable connector can comprise: a first contact; a second contact; a third contact; a fourth contact; the first, second, third, and fourth contacts in electrical communication when a device is not coupled to the interface, the first and second contacts electrically isolated and the third and fourth contacts electrically isolated when a device is coupled to the interface, the first and fourth contacts in electrical communication when a device is coupled to the interface.

In accordance with another exemplary embodiment, a device interface of a cable connector can comprise: a bottom member; a top member coupled to the bottom member, the top member rotatable relative to the bottom member between a first position and a second position; a first contact; a second contact in electrical and physical communication with the first contact when the top member is in the first position, the second contact spaced apart from the first contact when the top member is in the second position; a first receptacle for receiving a first terminal of a device; and a second receptacle for receiving a second terminal of a device.

The Detailed Description and accompanying Drawings further describe these and other exemplary embodiments of the cable connector and device interface.

DETAILED DESCRIPTION

Figure 1A:
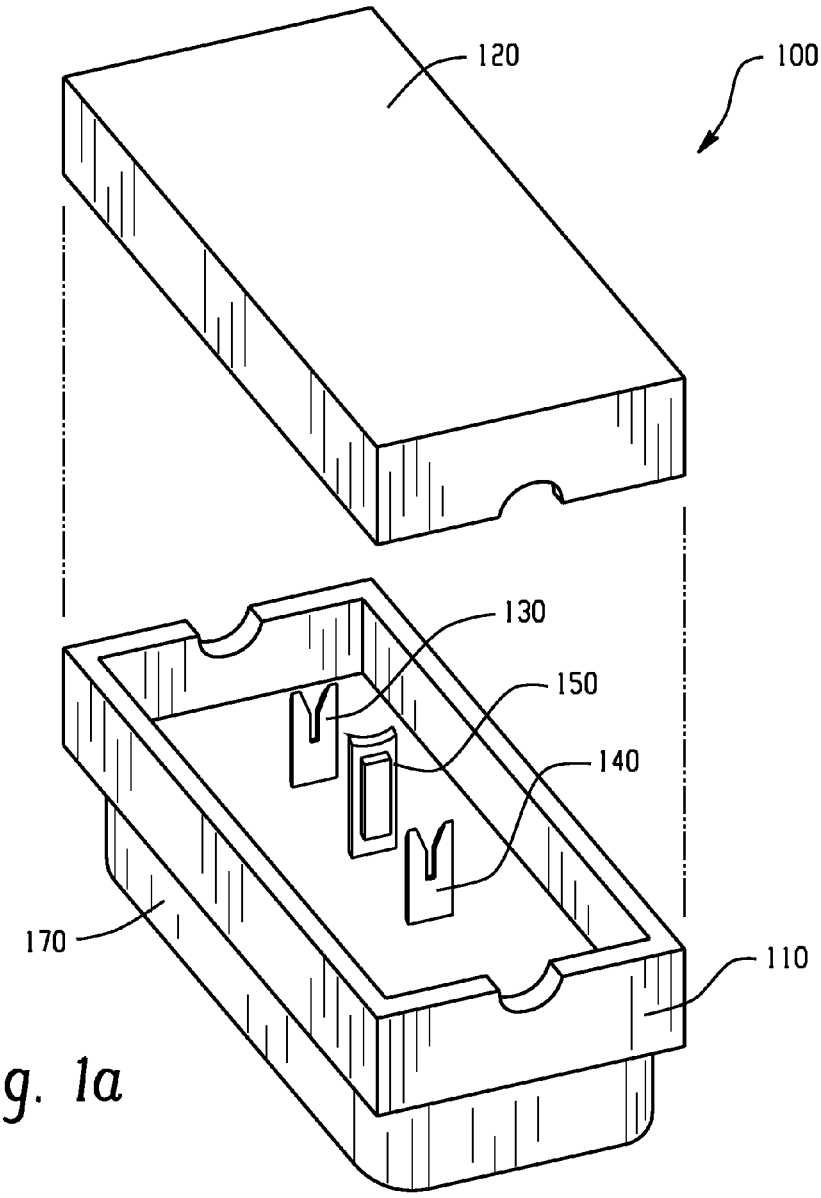
FIG. 1*a* illustrates an embodiment of a cable connector with a device interface.

FIG. 1*a* illustrates an embodiment of a cable connector 100 with a device interface 170. The cable connector comprises a base 110 and a cover 120. The cover 120 can be coupled to the base 110. The base 110 and cover 120 when coupled define an internal cavity that serves as a conduit that can receive a cable.

The cable connector 100 can comprise a first insulation displacement terminal 130 and a second insulation displacement terminal 140, both disposed on the base 110. The first and second insulation displacement terminals 130 and 140 are preferably composed of a conductive material. The first and second insulation displacement terminals 130 and 140 can be in electrical communication with the device interface 170. In an exemplary configuration, the first and second insulation displacement terminals 130 and 140 each can comprise a pair of pointed prongs extending from the base, spaced apart by a selected distance.

Figure 1B:
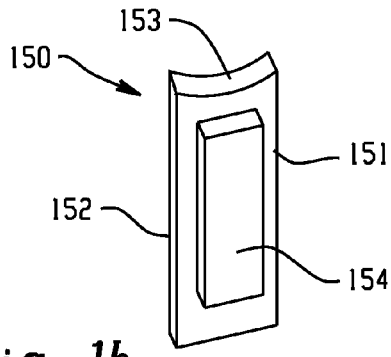
FIG. 1*b* illustrates an exemplary embodiment of an isolation terminal.

The cable connector 100 can further comprises a first isolation terminal 150 disposed on the base between the first and second insulation displacement terminals 130 and 140. FIG. 1*b* illustrates an exemplary embodiment of an isolation terminal 150. The isolation terminal 150*b* can be substantially flat and rectangular, having a first surface 151 and an opposite second surface 152. The portion of the isolation terminal 150 distal the base 110 can comprise a leading edge 153. The leading edge 153 is preferably sufficiently sharp to bisect a conductor within a cable when the cover 120 is coupled to the base 110. The isolation terminal 150 can comprise a first nonconductive element 154 disposed on the first surface 151. A second nonconductive element (not pictured) can be disposed on the second surface 152. The first nonconductive element 154 and the second nonconductive element are preferably in contact with the bisected ends of the conductor when the cover 120 is coupled to the base 110. In an alternative embodiments, the second nonconductive element can be omitted.

Figure 1C:
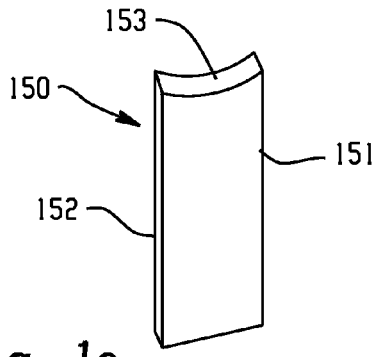
FIG. 1*c* illustrates an exemplary embodiment of a single piece isolation terminal.

FIG. 1*c* illustrates an exemplary embodiment of a single piece isolation terminal 150. The isolation terminal 150 can be formed from a single element having a first surface 151, a second surface 152, and a leading edge 153. The isolation terminal 150 can be composed of a nonconductive element. For example, the isolation terminal 150 can be composed of plastic or another suitable nonconductive element. The material selected is preferably sufficiently strong enough such that the leading edge 153 can cut through or bisect a conductor within a cable when the cover 120 is coupled to the base 110. Because the isolation terminal 150 in this embodiment is itself nonconductive, the first nonconductive element 154 and second nonconductive element described in relation to FIG. 1*b* can be omitted.

Figure 1D:
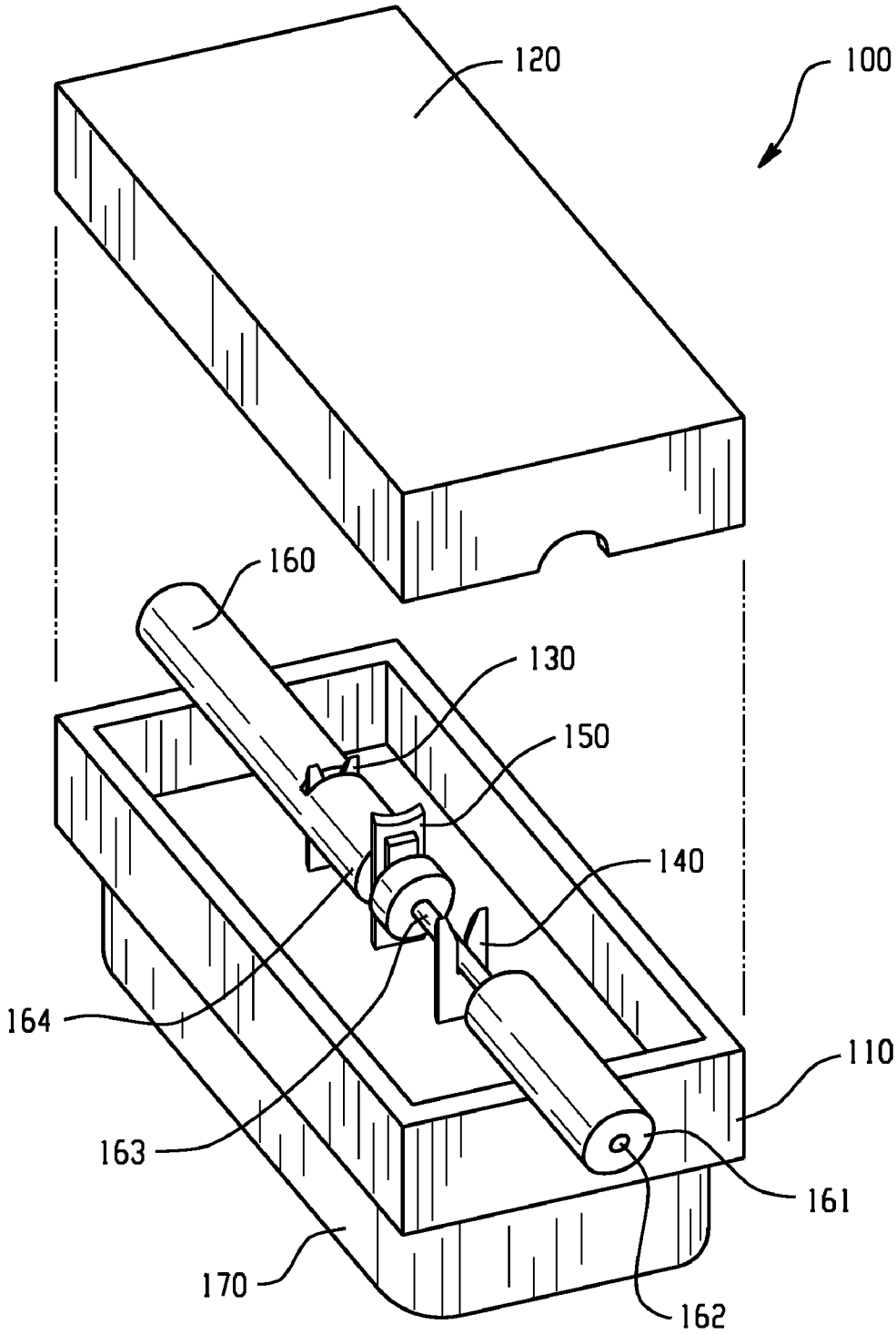
FIG. 1*d* illustrates a cable connector attached to a cable.

FIG. 1*d* illustrates a cable connector 100 attached to a cable 160. The cable 160 preferably comprises a conductor 162 surrounded by insulation 161. The cable connector 100 can attach to cable 160 by disposing the cable 160 between the cover 120 and the base 110 while coupling the base 110 and the cover 120. The cover 120 of the cable connector 110 in FIG. 1*c* is removed to illustrate the details of the attachment.

As the base 110 and cover 120 are coupled, the first and second insulation displacement terminals 130 and 140 preferably cut through the insulation 161 and come in physical and electrical communication with the conductor 162. Preferably, the first and second insulation displacement terminals 130 and 140 are narrower than the width of the cable 160 in order to minimize cutting through portions of the insulation 161 in order to maintain the structural integrity of the cable 160. Further, during coupling, the cable 160 can be aligned such that the conductor 160 is urged between the prongs of the first and second insulation displacement terminals 130 and 140 and is not severed or bisected. In other contemplated embodiments, the first and second insulation displacement terminals 130 and 140 can each comprise a single cutting element, rather than dual prongs, that cuts through the insulation 161 and comes in contact with the conductor 162.

The first isolation element 150 also can cut through the insulation 161 as the base 110 and cover 120 are coupled. The leading edge 153 can cut through a portion of the cable 160 or bisect the entire cable 160. The leading edge 153 preferably bisects the conductor 162 into a first bisected end 163 and a second bisected end 164. Bisected ends of a conductor as used herein refer to the portions of the conductor that have been physically and electrically isolated by an isolation terminal during coupling of the base 110 and cover 120, which were adjacent prior to the coupling. Bisected ends of the cable as used herein with refer to portions of the cable wherein the bisected ends of a conductor are disposed. As the base 110 and cover 120 are coupled, the first isolation element 150 can be urged through the cable 160 such that the first nonconductive element 154 is in physical contact with the first bisected end 163 of the conductor 162 and the second nonconductive element is in physical contact with the second bisected end 164 of the bisected conductor 162. Upon attaching the cable connector 100 to cable 160, electrical communication through conductor 162 is precluded as the first isolation element 150 cuts the conductor 162 into bisected ends 163 and 164, which are electrically isolated.

The device interface 170 can bridge the ends 163 and 164 by connecting to the bisected ends 163 and 164 using the first and second insulation displacement terminals 130 and 140. The device interface can selectively enable, disable, or otherwise regulate current flow between the bisected ends 163 and 164. This selective electrical communication will be described in greater detail below in relation to embodiments of the device interface 170. Consequently, when the cable connector 100 is attached to the cable 160, the conductor 162 within the cable is severed into two electrically isolated portions. Electrical communication between the bisected ends 163 and 164 preferably can occur through the first and second insulation displacement terminals 130 and 140 via the device interface 170.

In all embodiments of the cable connector 100, the base 110 can be attached to the cable 160 prior to coupling the base 110 and the cover 120. For example, the cable can be placed onto and pressed against the base 110 so that the insulation displacement terminals 130 and 140 cut through the insulation of the cable and isolation terminal 150 bisects the conductor of the cable. The cable can be pressed against the base 110 by hand or using a suitable tool. The cover 120 can then be coupled to the base 110.

Figure 2A:
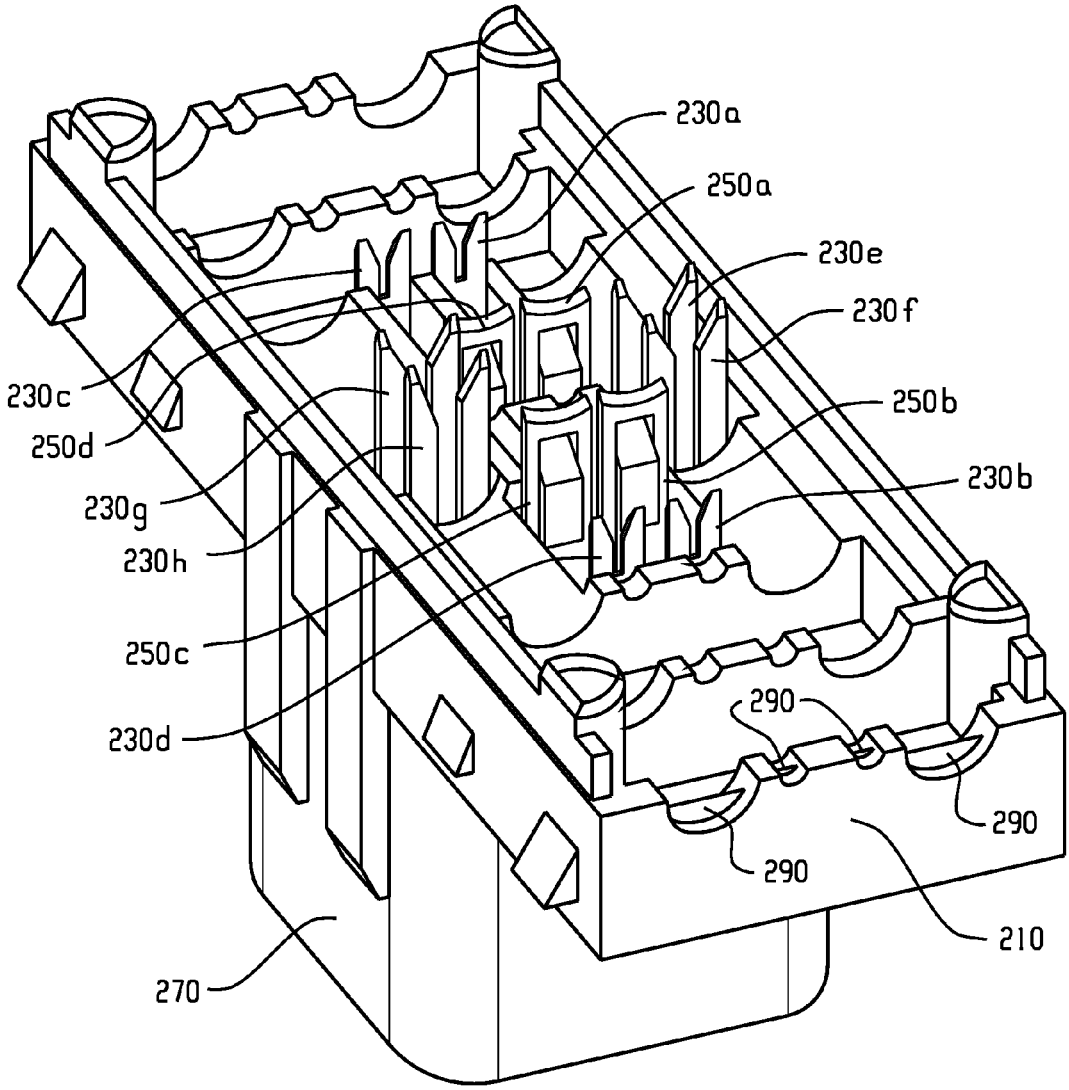
FIG. 2*a* illustrates a base of an exemplary embodiment of a cable connector for use with a cable having multiple separate conductors.

FIG. 2*a* illustrates a base 210 of an exemplary embodiment of a cable connector for use with a cable having multiple separate conductors. The base 210 illustrated in FIG. 2*a* is part of an exemplary embodiment of a cable connector adapted to attach to a flat cable having four parallel electrically isolated conductors. In this embodiments, it is contemplated that the two outside conductors are power and ground, and the inside conductors are data signals. The quantity and arrangement of power and data lines may be adapted based on system design preferences. The base 210 can comprise first and second insulation displacement terminals 230*a* and 230*b* and first and second isolation terminals 250*a* and 250*b* disposed there between. The first and second insulation displacement terminals 230*a* and 230*b* and first and second isolation terminals 250*a* and 250*b* are disposed in a single line to cut through or bisect the insulation surrounding a first conductor of a cable and come in physical and electrical communication with the first conductor.

The base 210 can further comprises third and fourth insulation displacement terminals 230*c* and 230*d* and third and fourth isolation terminals 250*c* and 250*d*, arranged similar to and substantially parallel with the first and second insulation displacement terminals 230*a* and 230*b* and first and second isolation terminals 250*a* and 250*b*. Alternatively, the insulation displacement terminals 230*c* and d can be offset from insulation displacement terminals 230*a* and *b*. The third and fourth insulation displacement terminals 230*c* and 230*d* and third and fourth isolation terminals 250*c* and 250*d* can cut through or bisect the insulation surrounding a second conductor of a cable and come in physical and electrical communication with the first conductor.

The base 210 can further comprise fifth and sixth insulation displacement terminals 230*e* and 230*f*. The fifth and sixth insulation displacement terminals 230*e* and 230*f* are disposed in a single line to cut through or bisect the insulation surrounding a third conductor of the cable.

The base 210 can further comprise seventh and eighth displacement terminals 230*g* and 230*h*. The seventh and eighth insulation displacement terminals 230*g* and 230*h* are disposed in a single line to pass through or bisect the insulation surrounding a fourth conductor of the cable and come in physical and electrical communication with the fourth conductor.

In the accordance with an exemplary embodiment of the base 210, the first and second conductors may be disposed between the third and fourth conductors. Consequently, the first, second, third, and fourth isolation terminals 250*a-d* and insulation displacement terminals 230*a-d* can be disposed between the fifth and sixth insulation displacement terminals 230*e* and 230*f* and the seventh and eighth insulation displacement terminals 230*g* and 230*h*. In other contemplated embodiments, the arrangement and number of conductors may vary. Consequently, the arrangement and number of insulation displacement and isolation terminals can vary as well depending on the type of cable used.

In this exemplary embodiment, the first, second, and fourth isolation terminals 250*a-d* can be substantially similar to the first isolation displacement terminal 150 described above. Further, the first through eighth insulation displacement terminals 230*a-h* can be substantially similar to the first and second insulation displacement terminals 130 and 140. The first and second insulation displacement terminals 230*a* and 230*b* can be in electrical communication via a device interface 270. Similarly, the third and fourth insulation displacement terminals 230*c* and 230*d*, fifth and sixth insulation displacement terminals 230*e* and 230*f*, and seventh and eighth insulation displacement terminals 230*g* and 230*h* can be in electrical communication via the device interface 270.

The base 210 can further comprise cable retention members 290. The cable retention member 290 can be protrusions in the housing of the base 210 through which a cable passes. The cable retention member 290 can press against or cut into the insulation of the cable when the connector 200 is attached to the cable. In this manner, the cable retention member can prevent the cable from sliding relative to the connector 200 and potentially breaking the terminals. A single or multiple cable retention members 290 can be employed depending on the size of the cable, the size of the cable retention member 290 and the particular type of application of the connector 200. For example, if the cable and cable connector 200 are likely to be physically disturbed or jostled, a multiple and/or stronger cable retention member 290 can be employed.

Figure 2B:
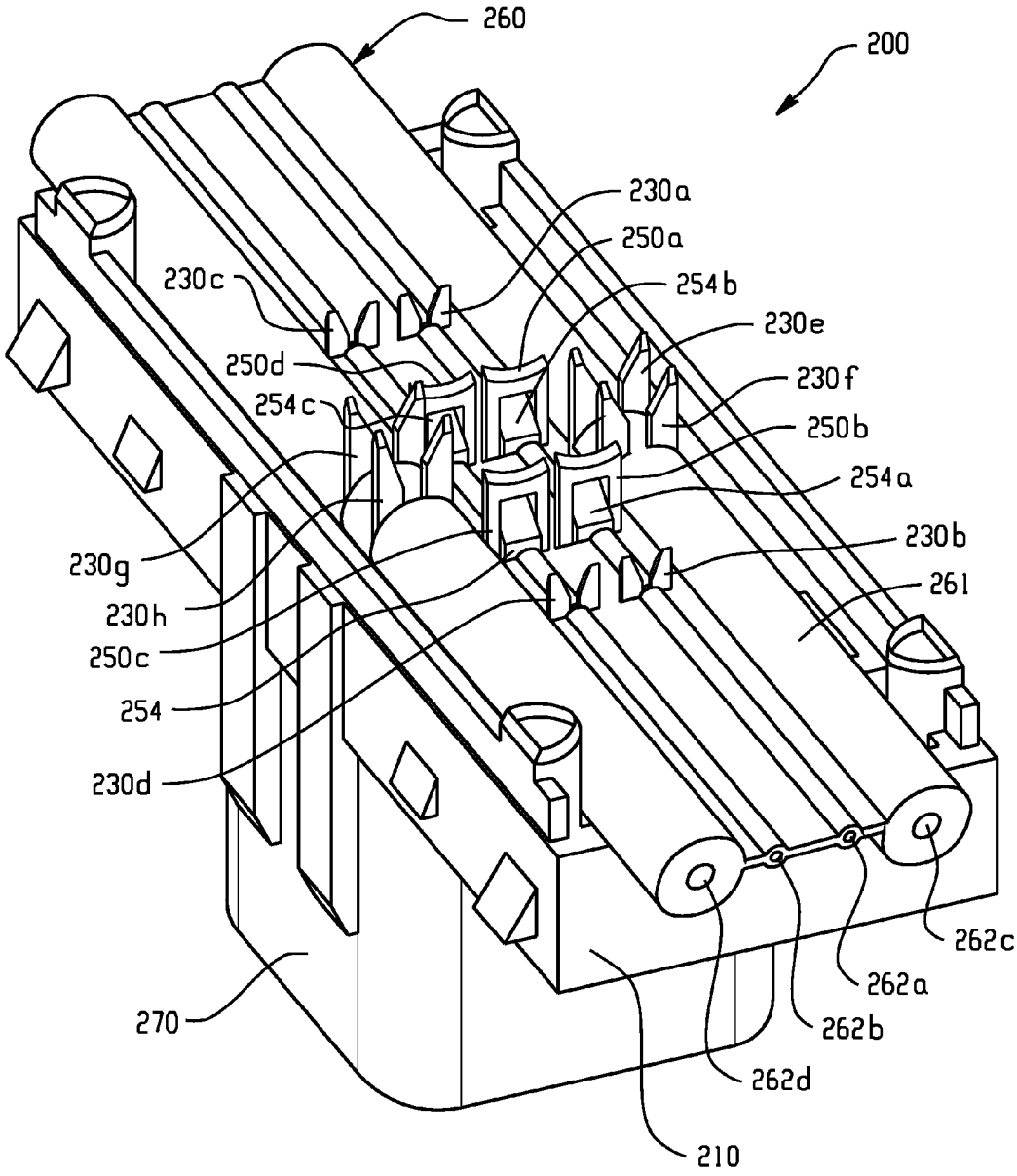
FIG. 2*b* illustrates the base of a cable connector attached to a cable.

FIG. 2*b* illustrates a base 210 of a cable connector 200 attached to a cable 260. The cable 260 is preferably of a flat ribbon type, comprising insulation 261 electrically isolating first, second, third, and fourth conductors 262*a-d*. In accordance with the illustrated embodiment, the first and second conductors 262*a* and 262*d* can carry a control signal, while the third and fourth conductors 262*c* and 262*d* can carry a power signal and ground. The cable connector 200 can attach to cable 260 by coupling the base 210 and the cover and disposing the cable 260 there between. The cover of the cable connector 200 in FIG. 2*b* is removed to illustrate the details of the attachment between the base 210 and the cable 260.

The first and second insulation displacement terminals 230*a* and 230*b* can pass completely though the insulation 261 and come in physical and electrical communication with conductor 262*a* without bisecting the conductor 262*a*. As described above, the first and second insulation displacement terminals 230*a* and 230*b* can comprise two prongs, passing on either side of the conductor 262*a*. In other contemplated embodiments, the first and second insulation displacement terminals 230*a* and 230*b* may comprise a single prong or blade that cuts through the insulation 261 to reach the conductor 262*a*.

The first isolation terminal 250*a* can cut through the insulation 261 and bisect the first conductor 262*a*. The first isolation terminal 250*a* can comprise a first nonconductive element 254*a* and a second nonconductive element (not pictured) disposed on opposite surfaces of the first isolation terminal 250*a* as described above in relation to FIG. 1*b*. The first nonconductive element 254*a* and second nonconductive element preferably also pass through the insulation 261 and are in physical communication with the bisected ends of the first conductor 262*a*. Consequently, the bisected ends of the first conductor are physically and electrically isolated by the first insulation terminal 250*a*. The second isolation terminal 250*b* is preferably substantially identical to the first isolation terminal 250*a* and similarly bisects the first conductor 262*a*. The second isolation terminal 250*b* is provided for redundancy and can be omitted in other contemplated embodiments.

The arrangement and function of the third and fourth isolation terminals 250*c* and 250*d* and third and fourth insulation displacement terminals 230*c* and 230*d* with respect to the second conductor 262*b* is preferably substantially similar to the first and second isolation terminals 250*a* and 250*b* and first and second insulation displacement terminals 230*a* and 230*b* and the first conductor 262*a*.

The fifth and sixth insulation displacement terminals 230*e* and 230*f* can cut through the insulation 261 and come in physical and electrical communication with the third conductor 262*c*. As described above, the fifth and sixth insulation displacement terminals 230*e* and 230*f* can comprise two prongs adapted to pass through the insulation 261 on either side of the third conductor 262*c* without bisecting the conductor 262*c*.

The sixth insulation displacement terminal 230*f* can be provided for redundancy to ensure that electrical communication is established with the third conductor 262*c* and/or to facilitate the penetrating of the insulation 261 with certain embodiments of the cover. For example, the cover can comprise elements disposed relative to the fifth and sixth insulation displacement terminals 230*e* and 230*f* for urging cable 260 onto the terminals 230*e* and 230*f*. In embodiments omitting the sixth insulation displacement terminal 230*f*, two such element may be required disposed on the cover in positions corresponding to either side of the fifth insulation displacement terminal 230*e*. In embodiments employing the sixth insulation displacement terminal 230*f*, a single element may be disposed on the cover in a position corresponding to an area between the fifth and sixth insulation displacement terminals 230*e* and 230*f*.

The arrangement and function of the seventh and eighth insulation displacement terminals 250*g* and 250*h* respect to the fourth conductor 262*d* is preferably substantially similar to the fifth and sixth insulation displacement terminals 250*e* and 250*f* and the third conductor 262*c*.

In accordance with the exemplary embodiment illustrated in FIG. 2*b*, attaching the cable connector to the cable 260 does not disrupt current flow through the third and fourth conductors 262*c* and 262*d* as the fifth, sixth, seventh, and eighth insulation displacement terminals 230*e-h* do not cut the conductors 262*c* and 262*d*. As previously discussed, the fifth, sixth, seventh, and eighth insulation displacement terminals 230*e-h* are preferably in electrical communication with the device interface 270 and the conductors 262*c* and 262*d*. The fifth, sixth, seventh, and eighth insulation displacement terminals 230*e-h* preferably provide a power source and ground to a device coupled to the device interface 270 by providing electrical communication to the conductors 262*c* and 262*d*.

Attaching the cable connector to the cable 260 does disrupt current flow through the first and second conductors 262*a* and 262*b* as the first, second, third, and fourth isolation terminals 250*a-d* bisect and electrically isolate the first and second conductors 262*a* and 262*b*. The first, second, third, and fourth insulation displacement terminals 230*a-d* provide electrical communication between the bisected ends of conductors 262*a* and 262*b* via the device interface 270. This electrical communication, however, preferably occurs whether or not a device is coupled to the device interface 270 as discussed in greater detail below.

The electrical communication between the bisected ends of conductors 262*a* and 262*b* may be regulated by the device coupled to the device interface 270. For example, the conductors 262*a* and 262*b* may carry control signals. These signals may be input to a device coupled to the device interface 270 via the first and third insulation displacement terminals 230*a* and 230*c* and the device interface 270. The signals may be processed by the device and output to the conductors 262*a* and 262*b* via the second and fourth insulation displacement terminals 230*b* and 230*d*.

The exemplary embodiment illustrated in FIGS. 2*a* and 2*b* and described above is adapted to be employed with a flat cable having four parallel conductors. In particular, the cable can have power and ground conductors and two control signal conductors there between. In other contemplated embodiments, more or fewer conductors may be employed. Further, the arrangement of the conductors relative to one another may vary. A plurality of embodiments of the cable connector are contemplated to correspond to different cable types having a varying number of conductors and arrangement of such conductors.

Figure 2C:
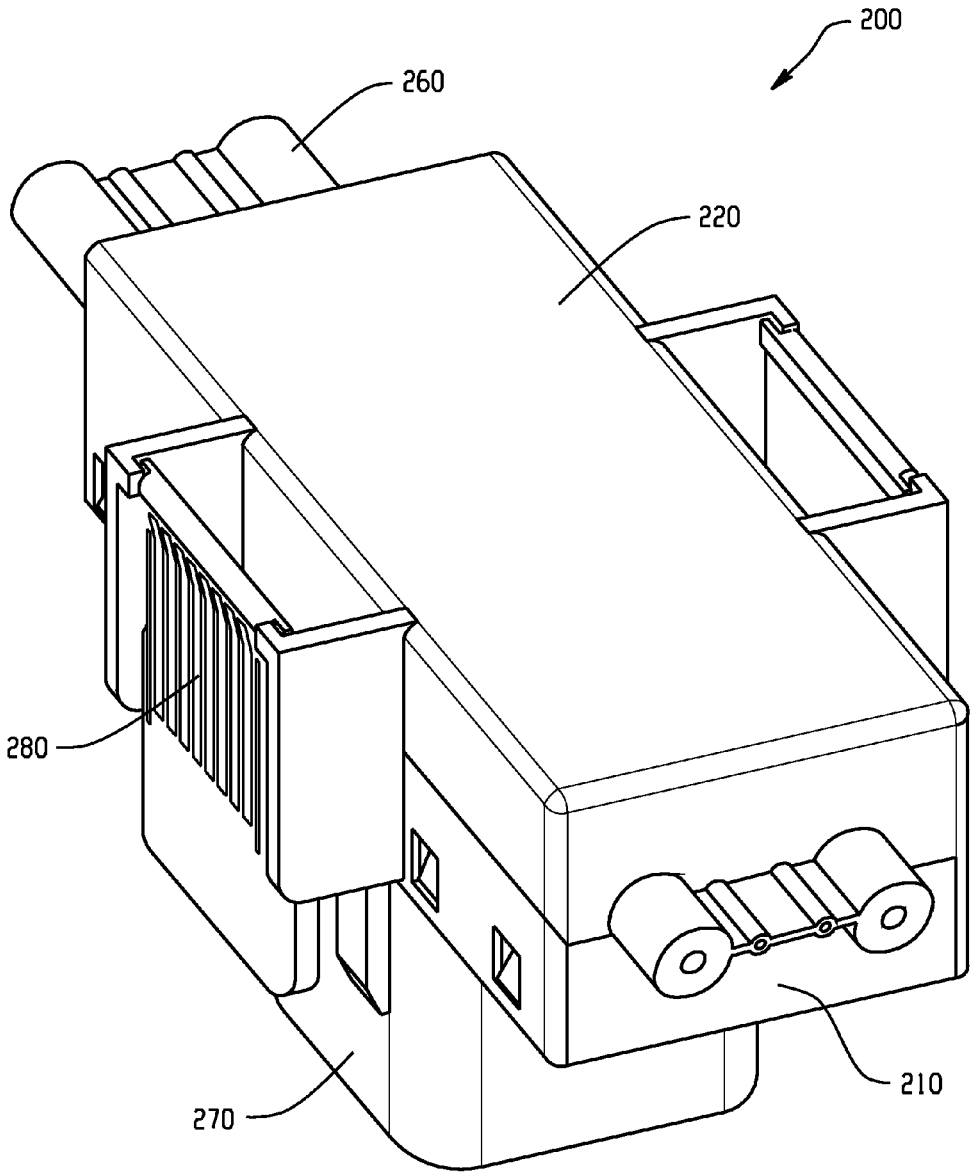
FIG. 2*c* illustrates a cable connector attached to a cable.

FIG. 2*c* illustrates a cable connector 200 attached to a cable 260. The cable 260 and base 210 illustrated in FIG. 2*c* are substantially similar to those illustrated in FIGS. 2*a* and 2*b*. The base 210 and cover 220 are coupled and substantially envelope a portion of the cable 260. The cover 220 and the base 210 can preferably easily be coupled by a user either with or without the assistance of tools. In an exemplary embodiment, the base 210 and cover 220 can be coupled using an integrated locking mechanism 280 that does not require additional tools depending on the embodiment. The integrated locking mechanism 280 could be a latch that forces the base 210 and cover 220 together and locks both in place relative to one another. Alternatively, the locking mechanism 280 could be another fastening means or mechanism suitable for urging the base 210 and cover 220 together and keeping the base 210 and cover 220 secure. The integrated locking mechanism 280 preferably releasably locks the base 210 and cover 220 together such that the two elements can be decoupled if desired.

In other embodiments, the cable connector 200 may not include an integrated locking mechanism 280, rather a fastening element and tool may be necessary for locking the base 210 and cover 220 together. For example, the base 210 and cover 220 could be locked together using a fastener such as a screw. Additionally In another contemplated embodiments, the base 210 and cover 220 can form a watertight or water resistant seal around the portion of the cable 260 disposed therein.

Figure 2D:
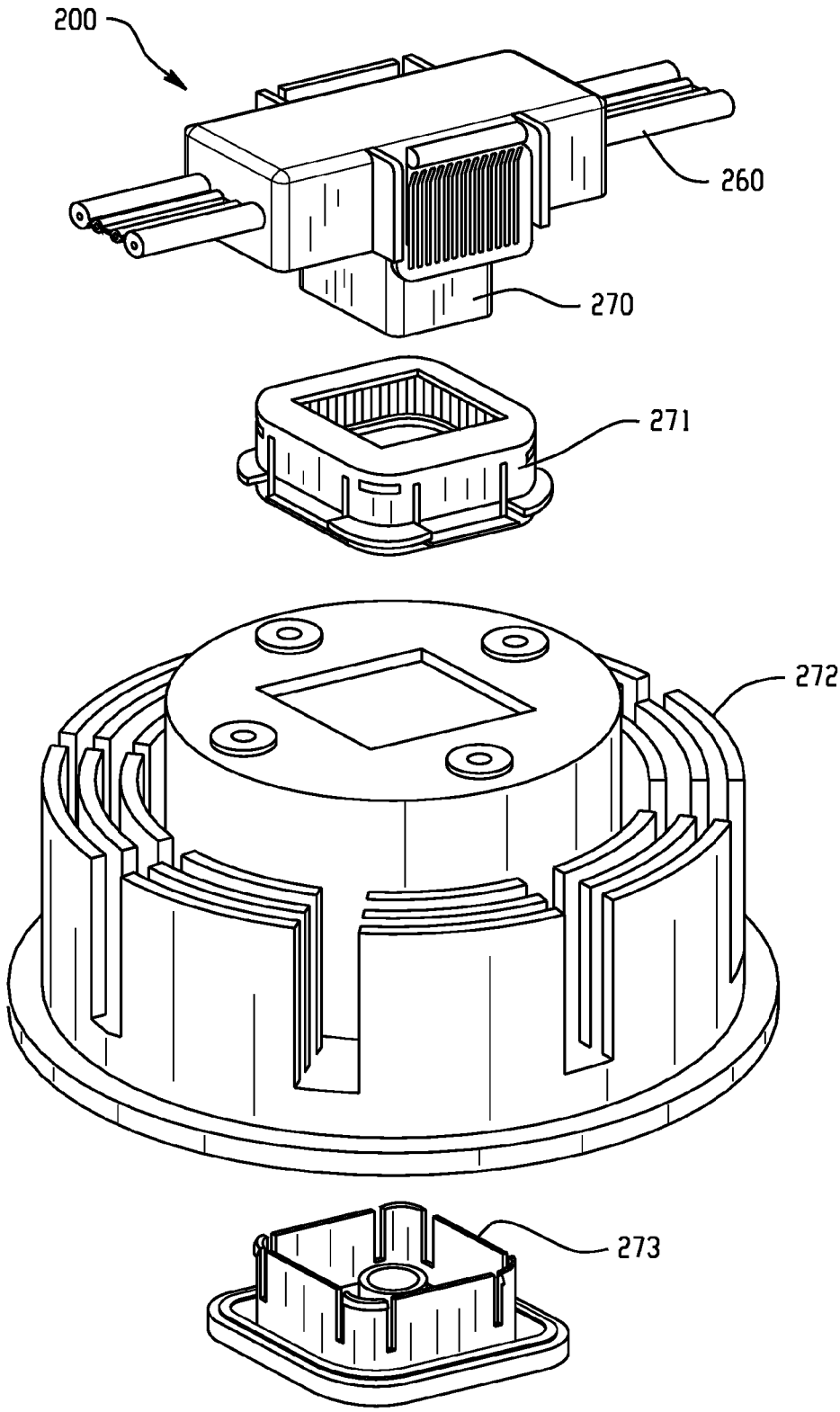
FIG. 2*d* illustrates a cable connector with exemplary device interface components.

FIG. 2*d* illustrates a cable connector with exemplary device interface components. In an exemplary embodiments, the device interface 270 of the cable connector 200 can comprise additional interface components 271, 272, and 273 for coupling and securing a device to device interface 270. The interface components 271, 272, and 273 are merely exemplary and not intended to specify a particular structure employed with embodiments of the cable connector 200. More or fewer components may be necessary for coupling a device to the device interface 270 depending on the type of device being employed.

Figure 3:
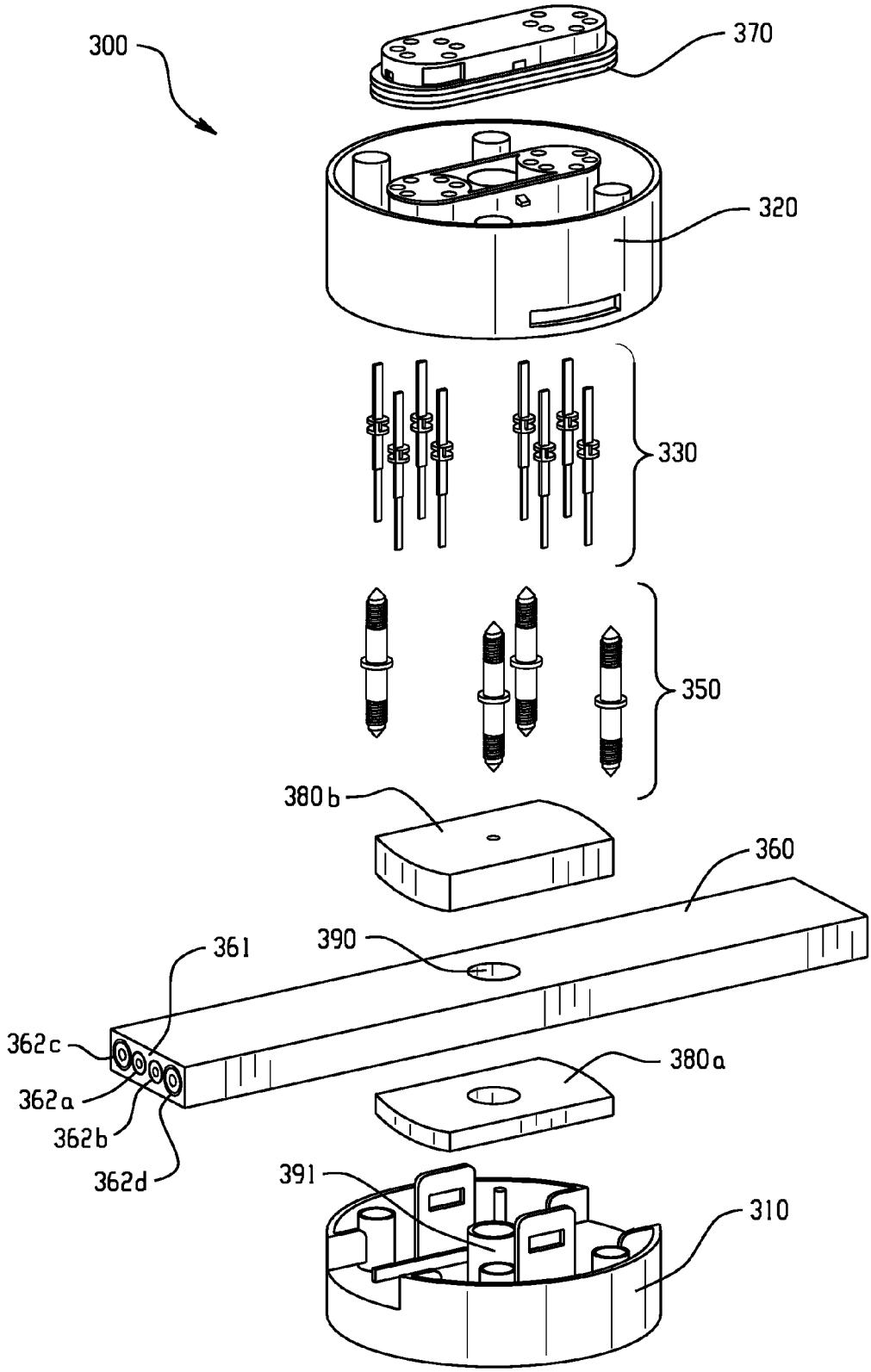
FIG. 3 illustrates an alternative exemplary embodiment of a cable connector.

FIG. 3 illustrates an exemplary embodiment of the cable connector 300. The connector 300 preferably comprises a base 310 and a cover 320 that can be coupled to the base 310. When coupled, the base 310 and cover 320 attach the cable connector 300 to a cable 360. The base 310 and cover 320 are preferably coupled using one or more fastening elements 350. The fastening elements 350 preferably comprise counter threaded portions at opposite ends of each element. The counter threaded portions preferably correspond to similarly threaded receptacles in the base 310 and cover 320. Turning or pressing the fastening elements 350 preferably urges the base 310 and cover 320 together.

An exemplary cable 360 employed with the cable connector 300 comprises four parallel conductors. In particular, the cable 360 can comprise a first conductor 362*a* and a second conductor 362*b* disposed adjacent one another, and a third conductor 362*c* and fourth conductor 362*d* disposed on the edges of the cable 360. In an exemplary configuration of the cable 360, conductors 362*a* and 362*b* carry control signals, and conductors 362*c* and 362*d* provide a power source and ground for a device coupled to the cable connector 300.

Prior to attaching the cable connector 300, the cable 360 preferably is pierced at a location desired for coupling a device to the cable 360. The cable 360 is preferably pierced with a suitable tool creating an aperture 390 in the cable 360. The aperture 390 preferably bisects and disrupts electrical communication through the first and second conductors 362*a* and 362*b*.

The cable connector 300 preferably comprises a lower sealing element 380*a* and an upper sealing element 380*b*. The upper and lower sealing elements 380*a* and 380*b* preferably comprise apertures corresponding to the aperture 390 of the cable 360. The upper and lower sealing elements 380*a* and 380*b* assist in attaching the cable connector 300 to the cable 360 and assure a snug and water tight fit. The aperture of the lower sealing element 380*a* preferably has substantially the same diameter as the aperture 390 of the cable 360. The cable connector 300 further can comprise a guide 391 preferably substantially equal in diameter to the aperture 390. Prior to coupling the base 310 and cover 320, the lower sealing element 380*a* can be disposed onto the base 310 such that the guide 391 extends through the aperture of the element 380*a*. The cable 360 preferably is disposed atop the lower sealing element 380*a* such that the guide 391 extends through the aperture 390. The upper sealing element 380*b* preferably is disposed atop the cable 360 such that its aperture overlaps the aperture 390 of the cable 360.

The cable connector preferably comprises a plurality of insulation displacement elements 330. The number and types of insulation displacement terminals 350 can vary based on the type of cable 360 being employed and the number of conductors within the cable 360. In an exemplary embodiment, the cable connector 300 comprises at least one insulation displacement terminal adapted to pierce the insulation 361 of the cable 360 and come in physical and electrical communication with a conductor carrying a power source. The cable connector further comprises at least one insulation displacement terminal adapted to pierce the insulation 361 of the cable 360 and come in physical and electrical communication with a conductor providing a ground.

The cable connector 300 can further comprises insulation displacement terminals 330 adapted to pierce the insulation 361 and come in physical and electrical communication with each of the conductors 362*a-d*. The cable connector 300 preferably comprises at least one insulation displacement terminal adapted to pierce the insulation 361 and come in physical and electrical communication with conductor 262*c* and at least one insulation displacement terminal adapted to pierce the insulation 361 and come in physical and electrical communication with conductor 262*d*.

The cable connector 300 preferably further comprises at least one insulation displacement terminal adapted to pierce the insulation 361 and come in physical and electrical communication with a portion of conductor 362*a* on a first side of aperture 390 and at least one insulation displacement member adapted to pierce the insulation 361 and come in physical and electrical communication with a portion of conductor 362*a* on an opposite side of aperture 390. The cable connector preferably further comprises insulation displacement terminals adapted to pierce the insulation and come in physical and electrical communication with the conductor 362*b* on opposing sides of aperture 390.

Prior to piercing through the insulation 361, the insulation displacement terminals 330 may pass through the upper sealing element 380*b*. After piercing through insulation 361, the insulation displacement terminals 330 may pass through the lower sealing element 338*a*. Elements 380*a* and *b* can be gel mats or another suitable material used to form a water tight seal around portions of cable 360 where the insulation 361 has been pierced, stripped, or otherwise removed.

The insulation displacement terminals 330 can be in electrical communication with a device interface 370. The insulation displacement terminals 330 in electrical communication with conductors 362*c* and *d* can provide a power and ground to the device interface 370. Similarly, the insulation displacement terminals 330 in electrical communication 362*a* and *b* can provide a control signal input and output for the device interface 370.

Upon attaching the cable connector 300 to cable 360, a device may be coupled to the device interface 370. The device can receive power and ground from conductors 362*c* and *d* via insulation displacement terminals 330. The device can further receive a control signal input from conductors 362*a* and *b* via insulation displacement terminals 330 in electrical communication with conductors 362*a* and *b* on one side of aperture 390. The device can output a signal via insulation displacement terminals in electrical communication with conductors 362*a* and *b* on an opposing side of aperture 390. In this manner, a control signal propagating through conductors 362*a* and *b* can be processed by a device as it is input into the device and output by the device in processed form.

The embodiment of the cable connector 300 as illustrated and described is adapted for use with a flat cable having four conductors. In other contemplated embodiments, the cable connector 300 can be employed with a having a different number of conductors without substantially departing from the design described above.

Figure 4A:
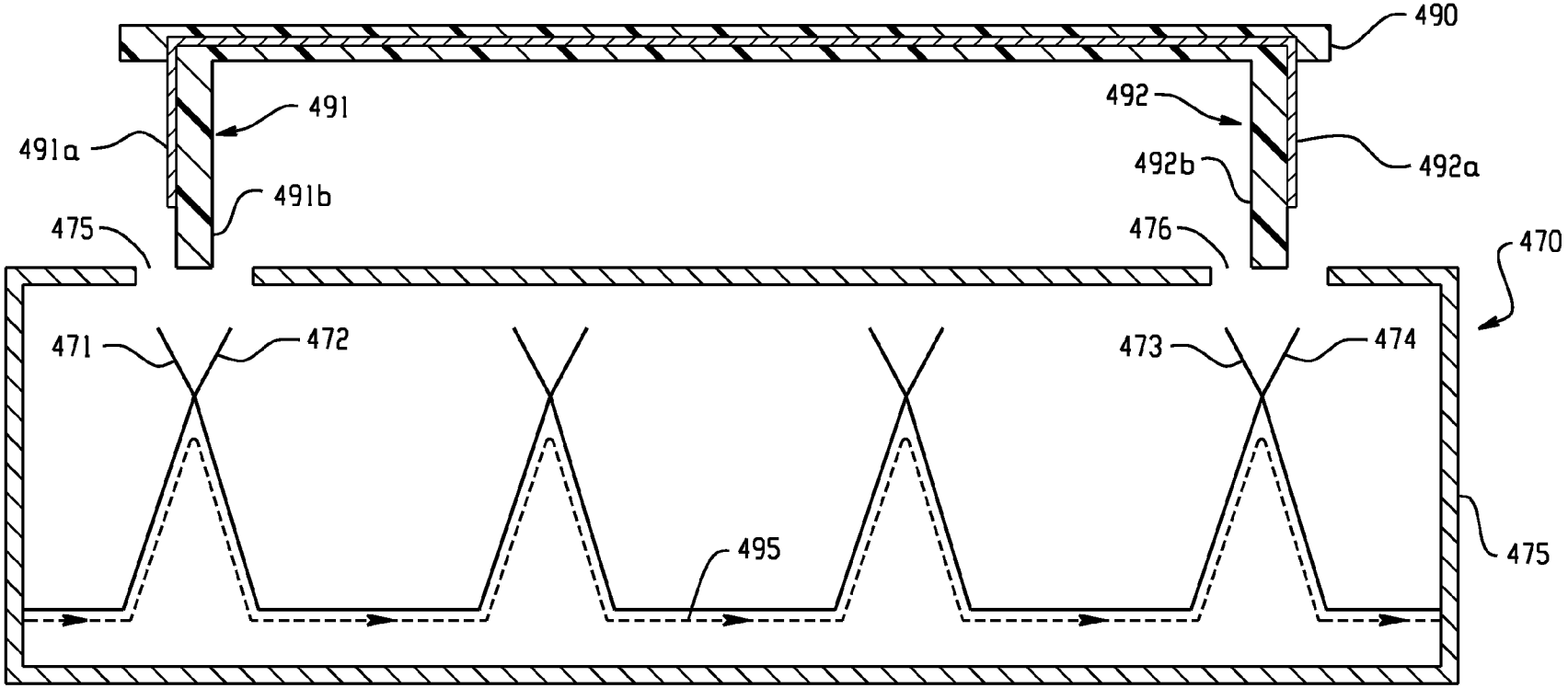
FIG. 4*a* illustrates an exemplary embodiment of device interface.

FIG. 4*a* illustrates an exemplary embodiment of a device interface 470. The device interface 470 can be an integral or separable part of any of the embodiments of the cable connector described above. The device interface 470 preferably comprises a housing 475 having a plurality of openings. The openings can enable a device 490 to couple with a device interface 470 by receiving the terminals of the device. In an exemplary embodiment, the housing 470 comprises a first opening 475 and a second opening 476. This exemplary embodiment is adapted to couple with a device 490 having a first terminal 491 and a second terminal 492.

In other contemplated embodiments, the housing 475 could have a different number of openings corresponding to the terminals of a particular device. For example, the housing 470 could have 4 openings corresponding to the four terminals of a device. In further contemplated embodiments, the device housing 475 could having more openings than there are terminals of a device being used, the additional openings not being employed when coupling with such a device.

The device interface 470 can have a plurality of articulating contacts. The device interface 470 of the exemplary embodiment preferably has at least four contacts 471-474. When a device is not coupled to the device interface 470, the contacts 471-474 are preferably in electrical communication. Line 495 illustrates current from in an exemplary embodiment from contact 471 to contact 474. The contacts 471 and 472 preferably are in electrical and physical communication as are contact 473 and 474. Contacts 471-474 are preferably in electrical communication with a conductor of the cable to which the cable connector is coupled. In an exemplary embodiment, the contact 471-474 are preferably in electrical communication with a conductor carrying a control signal that as been bisected as described in the embodiments above. Contact 471 can be in direct electrical communication with a first end of a bisected conductor via an insulation displace terminal such as described in the embodiments above. Contact 474 can be in direct electrical communication with a second end of the conductor also via an insulation displacement terminal. As discussed above, the ends of a bisected conductor are electrically isolated. The contacts 471-474 can enable electrical communication with the bisected ends.

When a device is not coupled to the device interface 470, the contacts 471-474 directly communicate current from a first bisected end of a conductor to a second bisected end. When device 490 is coupled to the device interface 470, the current from the first end of the bisected conductor preferably passes through the device before reaching the second end of the conductor, as will be discussed in more detail below.

In further contemplated embodiments, the device interface 470 can comprise fewer or more contacts corresponding to the number of openings in the housing 475 and terminals of a device without substantially departing from the design of the exemplary embodiments described herein.

Figure 4B:
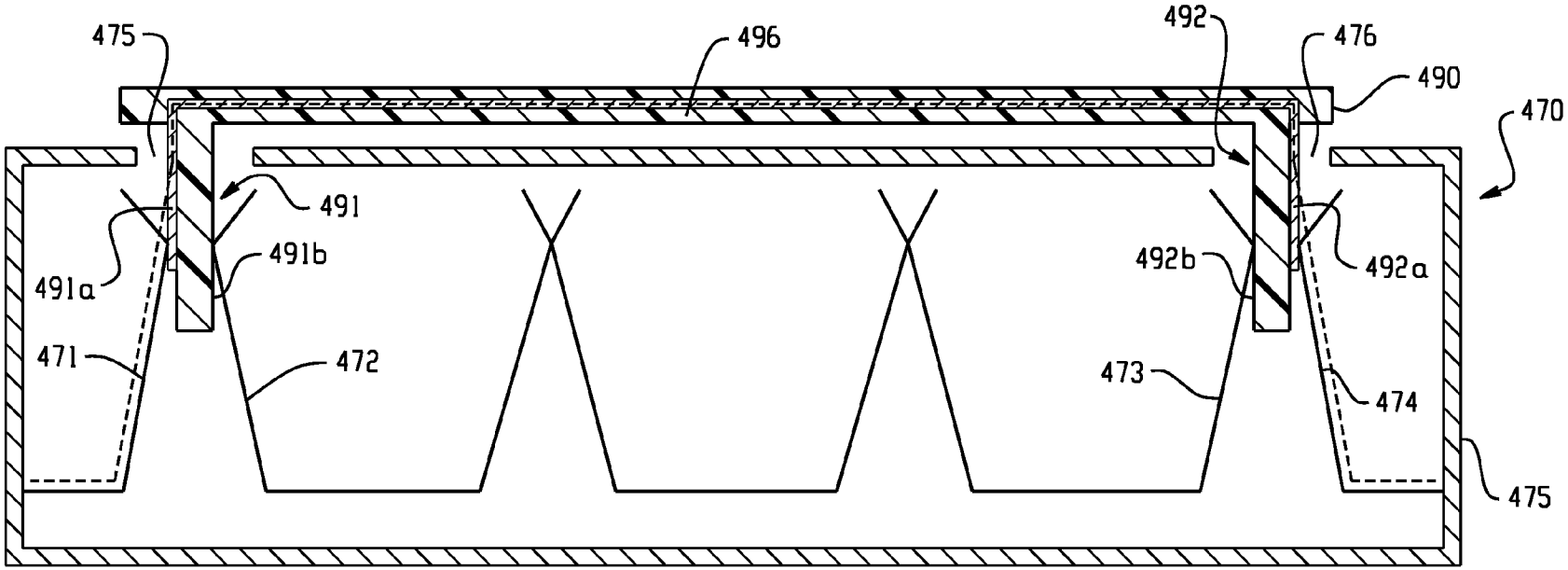
FIG. 4*b* illustrates a device interface coupled with a device.

FIG. 4*b* illustrates a device interface coupled with a device. The contacts 471-474 are preferably disposed proximate openings 475 and 476. In the exemplary embodiment, contacts 471 and 472 are preferably disposed proximate the first opening 475 and contacts 473 and 474 are preferably disposed proximate the second opening 476. The contacts 471-474 are preferably shaped to receive terminals 491 and 492. In an exemplary embodiment, contacts 471-474 can articulate relative to one another to receive a terminals 491 and 492. Contacts 471 and 472 preferably can be pushed apart as terminal 491 is coupled to the device interface 470 and inserted between contacts 471 and 472. Similarly, Contacts 473 and 474 preferably can be pushed apart as terminal 492 is coupled to the device interface 470 and inserted between contacts 473 and 474.

The contacts 471 and 472 can be under tensional forces that urge contacts 471 and 472 against each other when device 490 is not coupled to the interface 470 and urge contacts 471 and 471 against the terminal 491 when device 490 is coupled to interface 470. Similarly, contacts 473 and 474 can be under tensional forces that urge contacts 473 and 474 against each other when device 490 is not coupled to the interface 470 and urge contacts 473 and 474 against terminal 492 when device 490 is coupled to interface 470. The tensional forces in the contacts 471-474 preferably are greater when a device is coupled to interface 470 and the terminals 491 and 492 are inserted between the contacts 471-474. The tensional forces in the contacts 471-474 can urge the contacts toward each other to return to physical and electrical communication with each other when device 490 is decoupled from the device interface 470.

Terminal 491 preferably can have a conductive side 491*a* and a nonconductive side 491*b*. Similarly, terminal 492 preferably can have a conductive side 492*a* and a nonconductive side 492*b*. When terminals 491 and 492 are coupled to device interface 470 the electrical communication between contacts 471-474 is interrupted. In an exemplary embodiment, when device 490 is coupled to interface 470, contact 471 preferably is in physical and electrical communication with conductive side 491*a* and contact 472 preferably is in physical communication with nonconductive side 491*b*. Similarly, when device 490 is coupled to interface 470, contact 473 preferably is in physical and electrical communication with conductive side 492*a* and contact 474 preferably is in physical communication with nonconductive side 492*b*. Because nonconductive sides 491*b* and 492*b* preferably do not conduct electricity, contacts 472 and 473 preferably are not in electrical communication with side 491*b* and 492*b*. Consequently, contacts 472 and 473 are preferably isolated from contacts 471 and 474. Conductive sides 491*a* and 492*a* are preferably in electrical communication via device 490. Consequently, contacts 471 and 474 are preferably in electrical communication with each other when device 490 is coupled to device interface 470. Line 496 illustrates current flow when device 490 is coupled to interface 470.

In the exemplary embodiments described above, current can flow from a first end of a bisected conductor to a second end through contacts of a device interface when a device is not coupled to the device. When a device is coupled to the device interface, current can flow from a first end of a bisected conductor to a second end through the device. The current passing through the device is preferably processed such that the input and output of the signal from the device differ. When the device is decoupled from the interface, current can again flow from the first end of the bisected conductor through the device interface to a second end of the conductor.

Figure 4D:
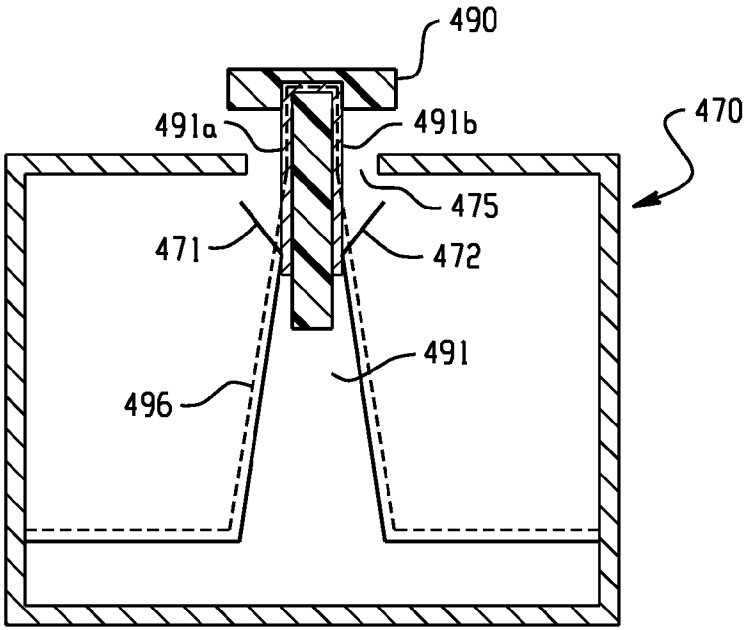
FIG. 4*d* illustrates a device interface coupled with a device with a single terminal.
Figure 4C:
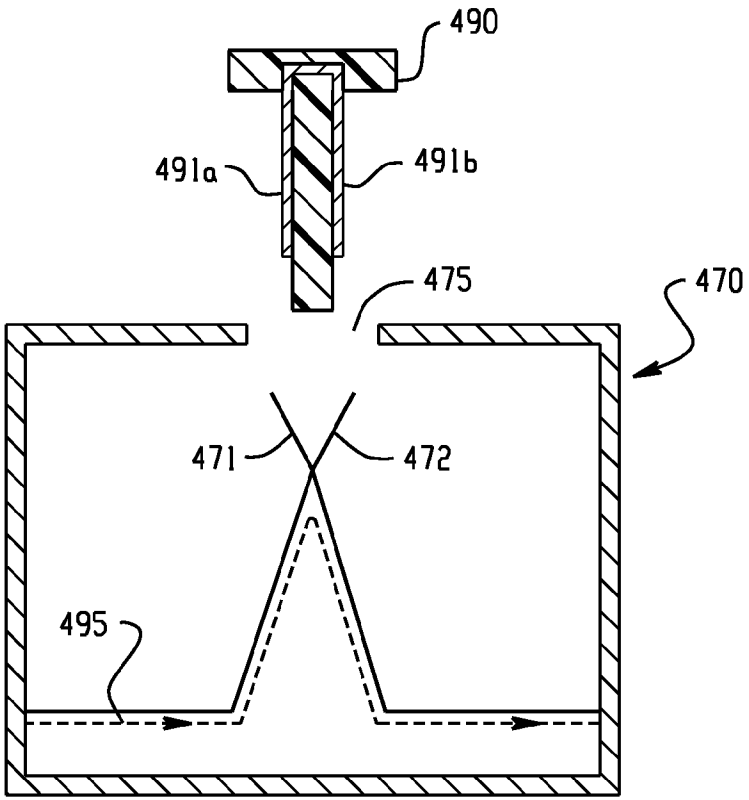
FIG. 4*c* illustrates an exemplary embodiment of a device interface for interfacing with a device having a single terminal.

FIG. 4*c* illustrates an exemplary embodiment of a device interface for interfacing with a device having a single terminal. The device interface 470 is preferably substantially similar as described above with the exceptions noted below. In the embodiment illustrated in FIG. 4*c* the device interface 470 preferably comprises a housing 475 having first opening 475 for coupling with a device 490 having a first terminal 491. Unlike the embodiment illustrated in FIG. 4*a*, the second opening 476 and second terminal 492 are preferably omitted in the embodiment illustrated in FIG. 4*c*.

The device interface 470 can have a plurality of articulating contacts. The device interface 470 of the exemplary embodiment preferably has a first contact 471 and a second contact 472. When a device is not coupled to the device interface 470, the contacts 471and 472 are preferably in electrical communication. Line 495 illustrates current from in an exemplary embodiment from contact 471 to contact 472. The contacts 471 and 472 preferably are in electrical and physical communication. Contacts 471 and 472 are preferably in electrical communication with a conductor of the cable to which the cable connector is coupled. In an exemplary embodiment, contacts 471 and 472 are preferably in electrical communication with a conductor carrying a control signal that as been bisected as described in the embodiments above. Contact 471 can be in direct electrical communication with a first end of a bisected conductor via an insulation displace terminal such as described in the embodiments above. Contact 472 can be in direct electrical communication with a second end of the conductor also via an insulation displacement terminal. As discussed above, the ends of a bisected conductor are electrically isolated. Contacts 471 and 472 can enable electrical communication with the bisected ends.

When a device is not coupled to the device interface 470, the contacts 471 and 472 directly communicate current from a first bisected end of a conductor to a second bisected end. When device 490 is coupled to the device interface 470, the current from the first end of the bisected conductor preferably passes through the device before reaching the second end of the conductor, as will be discussed in more detail below.

FIG. 4*d* illustrates a device interface coupled with a device with a single terminal. The contacts 471and 472 are preferably disposed proximate opening 475. Contacts 471 and 472 are preferably shaped to receive terminal 491. In an exemplary embodiment, contacts 471 and 472 can articulate relative to one another to receive a terminal 491. Contacts 471 and 472 preferably can be pushed apart as terminal 491 is coupled to the device interface 470 and inserted between contacts 471 and 472.

Contacts 471 and 472 can be under tensional forces that urge contacts 471 and 472 against each other when device 490 is not coupled to the interface 470 and urge contacts 471 and 472 against the terminal 491 when device 490 is coupled to interface 470. The tensional forces in the contacts 471 and 472 preferably are greater when a device in coupled to interface 470 and the terminal 491 is inserted between contacts 471 and 472. The tensional forces in contacts 471 and 472 can urge the contacts toward each other to return to physical and electrical communication with each other when device 490 is decoupled from the device interface 470.

Unlike the embodiment illustrated in FIGS. 4*a* and 4*b*, the in the embodiment illustrated in FIGS. 4*c* and 4*d* terminal 491 preferably can have a first conductive side 491*a* and a second conductive side 491*b*. The conductive sides 491*a* and 491*b* are preferably in electrical communication via the electronic circuitry of the device 490. In an exemplary embodiment, when device 490 is coupled to interface 470, contact 471 preferably is in physical and electrical communication with first conductive side 491*a* and contact 472 preferably is in physical communication with second conductive side 491*b*. Consequently, contacts 471 and 472 are in electrical communication via conductive sides 491*a* and 491*b* and the circuitry within the device 490. Line 496 illustrates current flow when device 490 is coupled to interface 470.

In the exemplary embodiments described above, current can flow from a first end of a bisected conductor to a second end through contacts of a device interface when a device is not coupled to the device. When a device is coupled to the device interface, current can flow from a first end of a bisected conductor to a second end through the device. The current passing through the device is preferably processed such that the input and output of the signal from the device differ. When the device is decoupled from the interface, current can again flow from the first end of the bisected conductor through the device interface to a second end of the conductor.

In another contemplated embodiment, an electrical switch could be used in place of contacts 471-474. The electrical switch can open and close depending on the status of the device coupled to the interface. For example, if a device is coupled to the interface, the electrical switch can be open so that current from a first end of a bisected conductor can be routed through the device before reaching the second end of a bisected conductor. If the device is decoupled/removed from the interface, the switch can close so that current passes from a first end of a bisected conductor to the second end of a bisected conductor through the device interface. Similarly, the switch can close when a module fails or malfunctions so that that current passes from a first end of a bisected conductor to the second end of a bisected conductor through the device interface. This is advantageous over the physical contacts 471-474, which cannot detect whether a device has malfunctioned. For example, if the device illustrated in FIG. 4*b* malfunctions and is no longer able to conduct current, current will not flow from a the first bisected end of a conductor to the second bisected end.

Figure 5B:
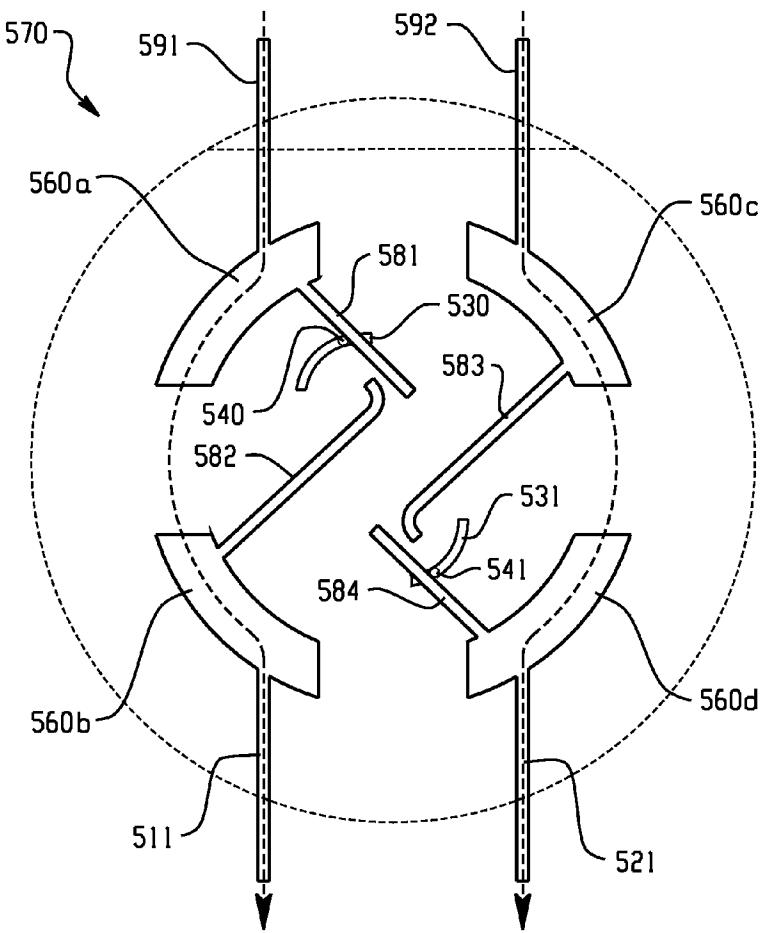
FIG. 5*b* illustrates a rotatable device interface with contacts in the open position.
Figure 5A:
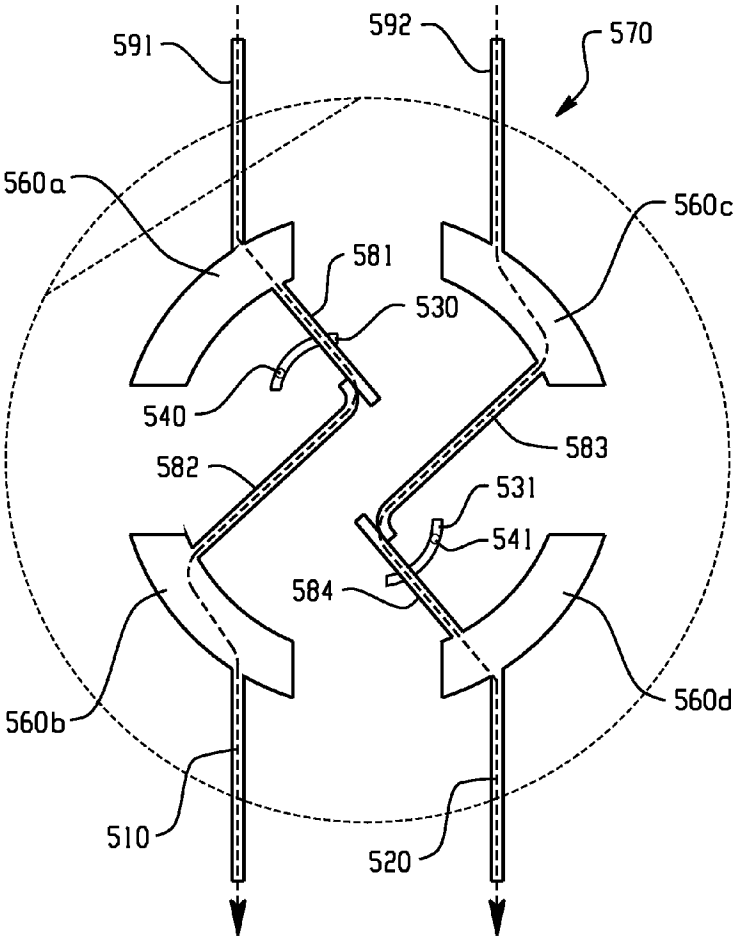
FIG. 5*a* illustrates a rotatable device interface with contacts in the closed position.

FIG. 5*a* illustrates an alternative rotatable device interface 570 with contacts in the closed position. In an exemplary embodiment, interface 570 comprises a portion fixed relative to the cable connector and a portion rotatable relative to the cable connector. The rotatable portion having a closed position in which contacts are closed and an open position in which contacts are open. The closed position adapted for providing continuous current flow through a cable when a device is not coupled to the device interface 570. The open position can enable current to be channeled through the device coupled to the device interface 570. The exemplary embodiments of the rotatable device interface 570 can be employed with the above described embodiments of the cable connector.

The device interface 570 preferably can have a plurality of receptacles adapted to receive the terminals of a device. In an exemplary embodiment, the device interface can have receptacles 560*a-d*. The device interface 570 preferably can have a plurality of contacts. The contacts are preferably in electrical communication with opposite ends of a bisected conductor via insulation displacement terminals as described above in various embodiments. In an exemplary embodiment, the device interface 570 can have contacts 581-584. Contacts 581 and 582 are preferably in physical and electrical communication when in the closed position and enable electrical communication between the bisected ends of a first conductor. Similarly, Contacts 583 and 584 are preferably in physical and electrical communication when in the closed position and enable electrical communication between the bisected ends of a second conductor. Lines 510 and 520 depict this current flow through the device interface in the closed position.

The device interface 570 can comprise a first channel 530 and a second channel 531. The device interface 570 can further comprise a first contact pin 540 and a second contact pin 541. The contact pins 540 and 541 preferably translate through the first and second channels 530 and 531, respectively, as the rotatable portion of the device interface 570 is transitioned between the open and closed positions.

In an exemplary embodiment, first and second contact pins 540 and 541 preferably are at a first end of the channels 530 and 531 when in the closed position. When the rotatable portion of the device interface 470 is transitioned to the open position, the contact pins 540 and 541 translate to the second end of channels 530 and 531. During the translation, the contact pins 540 and 541 preferably come into contact with contacts 581 and 584, respectively. The contact pins 540 and 541 preferably push contacts 581 and 584 away from contacts 582 and 583 such that the contacts are no longer in physical and electrical communication as the contact pins 540 and 541 transition to the open position. In other contemplated embodiments, the channels 530 and 531 can be omitted.

FIG. 5*b* illustrates a rotatable device interface 570 with contacts in the open position. Contact pins 540 and 541 preferably have pushed contacts 581 and 584 away from contacts 582 and 583. Consequently, electrical communication through the contacts 581-584 is disrupted and the bisected ends of the first and second conductors are electrically isolated. The receptacles 560*a-d* preferably are adapted to receive the terminals of a device. The receptacles 560*a-d* preferably are in electrical communication with the bisected ends of the first and second conductors and the terminals of the device. Therefore, when a device is coupled to the interface 570 electrical communication is preferably enabled between the bisected ends of the first and second conductors via receptacles 560*a-d* and the device itself. Line 511 and 521 depict this current flow. As described in the embodiments above, the device can process the signal such that the input and output are different. When the device is decoupled, the interface 570 can be returned to the closed position and current flow through the contacts 581-584 can be restored.

In other exemplary embodiments, the interface 570 can have a different number and arrangement of receptacles, contacts, and contact pins depending on the cable and device type employed without substantially departing from the embodiments described above.

Various exemplary embodiments have been disclosed above. It will be apparent to those skilled in the art that many modifications, additions, and deletions, especially in matters of shape, size, and arrangement of parts, can be made therein without substantially departing from the design function of the embodiments described herein. Therefore, other modifications or embodiments as may be suggested by the teachings herein are particularly reserved as they fall within the breadth and scope of the claims here appended.

Claimed is:

1. A cable connector for connecting to a cable having insulation, a first conductor, and first and second ends, the cable connector comprising:

a base comprising a first channel and a second channel for receiving the cable within the base, a guide adapted to span an aperture in the cable, the first and second channels and guide aligning the cable relative to the base;

a cover, the cover connecting to the base;

a first insulation displacement terminal in communication with the base and the cover;

a second insulation displacement terminal in communication with the base and the cover a first sealing element forming a water tight seal around a first area of the insulation pierced by the first insulation displacement terminal and the second insulation displacement terminal; and a second sealing element forming a water tight seal around a second area of the insulation pierced by the first insulation displacement terminal and the second insulation displacement terminal.

2. The cable connector of claim 1, further comprising:

a first isolation terminal disposed between the first insulation displacement terminal and second insulation displacement terminal.

3. The cable connecter of claim 2, the first and second insulation displacement terminals adapted to pass through the insulation of the cable and into electrical communication with the first conductor of the cable when the cable connector is coupled to the cable.

4. The cable connector of claim 2, the first isolation terminal comprising:

a cutting element having a first surface, a second surface, and a leading edge, the leading edge bisecting the first conductor when the base and cover are connected;

a first nonconductive element disposed proximate the first surface, the first nonconductive element preventing electrical communication between the first conductor and the first surface when the cable connector is coupled to the cable.

5. The cable connector of claim 4, the first and second nonconductive elements integrally formed with the base.

6. A cable connector for connecting to a cable having insulation, a first conductor, and first and second ends, the cable connector comprising:

a base;

a cover, the cover connecting to the base, the base and cover when connected defining a conduit for receiving the cable;

a first insulation displacement terminal cutting through the insulation and coming in physical and electrical communication with the first conductor disposed on the base;

a second insulation displacement terminal cutting through the insulation and coming in physical and electrical communication with the first conductor disposed on the base;

a first isolation terminal disposed between the first insulation displacement terminal and second insulation displacement terminal, the first isolation terminal bisecting the insulation and first conductor of the cable when the cable connector is coupled to the cable; and wherein the first isolation terminal comprises a cutting element have a first surface, a second surface, and a leading edge, the leading edge bisecting the first conductor when the base and cover are connected, the cutting element composed of a nonconductive material.

7. The cable connecter of claim 6, the first and second insulation displacement terminals adapted to pass through the insulation of the cable and into electrical communication with the first conductor of the cable when the cable connector is coupled to the cable.

8. The cable connector of claim 6, the first isolation terminal comprising a cutting element having a first surface, a second surface, and a leading edge, the leading edge bisecting the first conductor when the base and cover are connected, the cutting element composed of a nonconductive material.

9. The cable connector of claim 6, the first isolation terminal comprising:

a cutting element having a first surface, a second surface, and a leading edge, the leading edge bisecting the first conductor when the base and cover are connected;

a first nonconductive element disposed proximate the first surface, the first nonconductive element preventing electrical communication between the first conductor and the first surface when the cable connector is coupled to the cable.

10. The cable connector of claim 9, the first and second nonconductive elements integrally formed with the base.

11. The cable connector of claim 6 further comprising:

a third insulation displacement terminal disposed on the base adapted to pass through the insulation and into electrical communication with a second conductor of the cable when cable connector is coupled to the cable;

a fourth insulation displacement terminal disposed on the base adapted to pass through the insulation and into electrical communication with a second conductor of the cable when the cable connector is coupled to the cable; and a second isolation terminal disposed between the third insulation displacement terminal and fourth insulation displacement terminal.

12. The cable connector of claim 11 further comprising:

a fifth insulation displacement terminal disposed on the base adapted to pass through the insulation and into electrical communication with a third conductor of the cable when cable connector is coupled to the cable; and a sixth insulation displacement terminal disposed on the base adapted to pass through the insulation and into electrical communication with a third conductor of the cable when the cable connector is coupled to the cable.

13. The cable connector of claim 12 further comprising:

a seventh insulation displacement terminal disposed on the base adapted to pass through the insulation and into electrical communication with a fourth conductor of the cable when cable connector is coupled to the cable; and a eighth insulation displacement terminal disposed on the base adapted to pass through the insulation and into electrical communication with a fourth conductor of the cable when the cable connector is coupled to the cable.

14. The cable connector of claim 13, the first, second, third, and fourth conductors being coplanar.

15. The cable connector of claim 13, wherein first, second, third, and fourth conductors are not coplanar.

16. The cable connector of claim 13 further comprising:

a device interface adapted to couple an electronic device with the cable connector, the fifth and sixth insulation displacement terminals providing electrical communication between the third conductor and the device interface, the third conductor providing a power source for the electronic device, the first and second insulation displacement terminals providing electrical communication between the first conductor and the device interface, the electronic device receiving a control signal through the first insulation displacement terminal and outputting a control signal through the second insulation displacement terminal.

17. The cable connector of claim 2 further comprising:

a third insulation displacement terminal disposed on the base adapted to pass through the insulation and into electrical communication with a second conductor of the cable when cable connector is coupled to the cable;

a fourth insulation displacement terminal disposed on the base adapted to pass through the insulation and into electrical communication with a second conductor of the cable when the cable connector is coupled to the cable; and a second isolation terminal disposed between the third insulation displacement terminal and fourth insulation displacement terminal.

18. The cable connector of claim 17 further comprising:

a fifth insulation displacement terminal disposed on the base adapted to pass through the insulation and into electrical communication with a third conductor of the cable when cable connector is coupled to the cable; and a sixth insulation displacement terminal disposed on the base adapted to pass through the insulation and into electrical communication with a third conductor of the cable when the cable connector is coupled to the cable.

19. The cable connector of claim 18 further comprising:

a seventh insulation displacement terminal disposed on the base adapted to pass through the insulation and into electrical communication with a fourth conductor of the cable when cable connector is coupled to the cable; and a eighth insulation displacement terminal disposed on the base adapted to pass through the insulation and into electrical communication with a fourth conductor of the cable when the cable connector is coupled to the cable.

20. The cable connector of claim 19, the first, second, third, and fourth conductors being coplanar.

21. The cable connector of claim 19, wherein first, second, third, and fourth conductors are not coplanar.

22. The cable connector of claim 19 further comprising:

a device interface adapted to couple an electronic device with the cable connector, the fifth and sixth insulation displacement terminals providing electrical communication between the third conductor and the device interface, the third conductor providing a power source for the electronic device, the first and second insulation displacement terminals providing electrical communication between the first conductor and the device interface, the electronic device receiving a control signal through the first insulation displacement terminal and outputting a control signal through the second insulation displacement terminal.

23. A cable connector having a device interface, the device interface comprising:

a first contact;

a second contact;

a third contact;

a fourth contact;

the first, second, third, and fourth contacts in electrical communication by directly communicating current flow from a first bisected end of a conductor to a second bisected end through each of the first, second, third, and fourth contacts when a device is not coupled to the interface, the first and second contacts electrically isolated and the third and fourth contacts electrically isolated when a device is coupled to the interface; and the first and fourth contacts in electrical communication by directly communicating current flow from a first bisected end of a conductor to a second bisected end through the device when the device is coupled to the interface.

24. The cable connector of claim 23, the first contact and the second contact in physical communication when a device is not coupled to the device interface, the first and second contacts receiving a terminal of a device, the terminal inserted between the first and second contacts when the device is coupled to the device interface.

25. The cable connector of claim 24, the terminal having a conductive portion and a nonconductive portion, the first contact in physical and electrical communication with conductive portion, the second contact in physical communication with the nonconductive portion.

26. A cable connector having a device interface, the device interface comprising:

a first contact;

a second contact;

a third contact;

a fourth contact;

the first, second, third, and fourth contacts in electrical communication by directly communicating current flow from a first bisected end of a conductor to a second bisected end through each of the first, second, third, and fourth contacts when a device is not coupled to the interface; and the first and second contacts electrically isolated and the third and fourth contacts electrically isolated when a device is coupled to the interface, the first and fourth contacts in electrical communication by directly communicating current flow from a first bisected end of a conductor to a second bisected end through the device when the device is coupled to the interface; and a first tensional force within the first contact causing the first contact to exert a first force on the second contact when a device is not coupled to the device interface, a second tensional force within the second contact causing the second contact to exert a second for on the first contact when a device is not coupled to the device interface, the first and second tensional forces increasing when a device is coupled to the device interface, the first and second tensional forces translating the first and second contacts into physical contact when the device is removed from the device interface.

27. The cable connector of claim 26, the first contact and the second contact in physical communication when a device is not coupled to the device interface, the first and second contacts receiving a terminal of a device, the terminal inserted between the first and second contacts when the device is coupled to the device interface.

28. The cable connector of claim 26, the terminal having a conductive portion and a nonconductive portion, the first contact in physical and electrical communication with conductive portion, the second contact in physical communication with the nonconductive portion.

29. A cable connector having a device interface, the device interface comprising:

a bottom member;

a top member coupled to the bottom member, the top member rotatable relative to the bottom member between a first position and a second position;

a first contact;

a second contact in electrical and physical communication with the first contact by directly communicating current from a first bisected end of a conductor to a second bisected end of a conductor through each of the first and second contacts when the top member is in the first position, the second contact spaced apart from the first contact when the top member is in the second position;

a first receptacle for receiving a first terminal of a device; and a second receptacle for receiving a second terminal of a device.

30. A cable connector having a device interface, the device interface comprising:

a first contact;

a second contact;

the first and second contacts in direct electrical communication by directly communicating current from a first bisected end of a conductor to a second bisected end of a conductor through each of the first and second contacts when a device is not coupled to the interface, the first and second contacts in electrical communication through a device when a device is coupled to the interface; and an electrical switch, the switch having an open position and a closed position, the switch in the closed enabling direct electrical communication between the first contact and the second contact, wherein the switch is in the open position when a device is coupled to the interface and the switch is in the closed position when a device is not coupled to the interface or a device coupled to the interface malfunctions.

* * * * *